US008353081B2

(12) United States Patent
Lai

(10) Patent No.: US 8,353,081 B2
(45) Date of Patent: Jan. 15, 2013

(54) SLIDE-COVER HANDLEBAR DEVICE

(76) Inventor: Chu Shan Lai, Xinzhuang (TW)

( * ) Notice: Subject to any disclaimer, the term of this patent is extended or adjusted under 35 U.S.C. 154(b) by 384 days.

(21) Appl. No.: 12/836,317

(22) Filed: Jul. 14, 2010

(65) Prior Publication Data

US 2011/0088216 A1 Apr. 21, 2011

(30) Foreign Application Priority Data

Oct. 16, 2009 (TW) ..... 98219132 U

(51) Int. Cl.
*A45C 7/00* (2006.01)

(52) U.S. Cl. ..... 16/113.1; 190/115

(58) Field of Classification Search ..... 16/113.1, 16/405, 429; 190/18 A, 115; 280/47.371, 280/47.17, 655, 655.1; 403/109.3, 109.6, 403/109.7, 109.2, 109.5
See application file for complete search history.

(56) References Cited

U.S. PATENT DOCUMENTS

| | | | | |
|---|---|---|---|---|
| 5,511,441 | A * | 4/1996 | Arai | 74/501.6 |
| 5,692,266 | A * | 12/1997 | Tsai | 16/113.1 |
| 6,026,543 | A * | 2/2000 | Chen | 16/113.1 |
| 7,467,696 | B2 * | 12/2008 | Wu | 190/115 |
| 7,752,710 | B2 * | 7/2010 | Lin | 16/334 |
| 2008/0120806 | A1 * | 5/2008 | Liu | 16/277 |
| 2009/0279884 | A1 * | 11/2009 | Matsumoto | 396/448 |
| 2010/0088848 | A1 * | 4/2010 | Chiang | 16/113.1 |

* cited by examiner

*Primary Examiner* — Chuck Y. Mah
(74) *Attorney, Agent, or Firm* — Muncy, Geissler, Olds & Lowe, PLLC

(57) ABSTRACT

The present invention discloses a slide-cover handlebar device whose handlebar body has a slide cover to conceal the button arranged in a recession of the handlebar body, and whose handlebar body also has a torsion spring. The torsion spring has a fixing ring press-fitted with a fixing protrusion of the slide cover. When the slide cover is pulled or pushed, the torsion spring is also driven to move. When the pulling or pushing force has reached a critical point, the torsion spring generates a rotation torsion force to keep on pulling or pushing the slide cover to reveal or conceal a button. The present invention can protect the button from being imprudently pressed. The torsion spring can assist the user in opening or shutting the slide cover.

8 Claims, 6 Drawing Sheets

SLIDE-COVER HANDLEBAR DEVICE

BACKGROUND OF THE INVENTION

1. Field of the Invention

The present invention relates to a slide-cover handlebar device, particularly to a slide-cover handlebar device for holding a pull handle of a luggage trunk.

2. Description of the Related Art

In modern society, people travel via various traffic means, such as automobiles, high speed rails, passenger liners, or aircrafts. A traveler usually carries his personal belongings, such as clothes, shoes, stockings, and bathroom kits, with a luggage trunk. The current luggage trunks usually have extendible pull handles integrated with the trunks.

Refer to FIG. 6 for a conventional pull handle of a luggage trunk. As shown in FIG. 6, a luggage trunk 50 has an extendible pull handle 52, and the extendible pull handle 52 has a handlebar 54 to be held by the user. The handlebar 54 has a button 56. The user presses the button 56 to extend or retract the pull handle 52, whereby the user can conveniently pull or lift the luggage trunk 50.

However, the button 56 on the handlebar 54 is exposed externally in the conventional the extendible pull handle 52. Sometimes, the user may imprudently press the button 56 when pulling or lifting the luggage trunk 50. In such a condition, the pull handle 54 will suddenly extend or retract, which should greatly inconvenience the user. Therefore, the present invention proposes a slide-cover handlebar device to solve the abovementioned problem, wherein the slidable cover can be shut to protect the button 56 from being imprudently pressed, and wherein a mechanism is used to assist the user in sliding the cover.

SUMMARY OF THE INVENTION

The primary objective of the present invention is to provide a slide-cover handlebar device, wherein a torsion spring is used to assist the user in opening and shutting the cover, whereby the user can easily extend or retract the extendible pull handle of a luggage trunk.

Another objective of the present invention is to provide a slide-cover handlebar device, which can fully protect the button that is arranged in a recession from being imprudently pressed.

To achieve the abovementioned objectives, the present invention proposes a slide-cover handlebar device, which comprises a handlebar body. The handlebar body has a recession. The recession has a hole and a slide track. The recession also has two slide grooves on two sides thereof. A torsion spring is installed inside the recession. A button is installed inside the hole. The torsion spring has a fixing ring arranged corresponding to the slide track. A slide cover is used to cover the recession. The inner surface of the slide cover has a fixing protrusion press-fitted with the fixing ring. When slid along the slide grooves, the slide cover drives the torsion spring to move and generate a rotation torsion force. The rotation torsion force drives the slide cover to keep on sliding.

Below, the embodiments are described in detail in cooperation with the attached drawings to make easily understood the objectives, technical contents, characteristics and accomplishments of the present invention.

DETAILED DESCRIPTION OF THE INVENTION

The present invention proposes a slide-cover handlebar device. The sliding of the slide cover makes a torsion spring generate a rotation torsion force to keep on pulling the slide cover, whereby the user can easily operate the slide cover. Below, the embodiments are described in detail to demonstrate the technical characteristics of the present invention.

Figure 1:
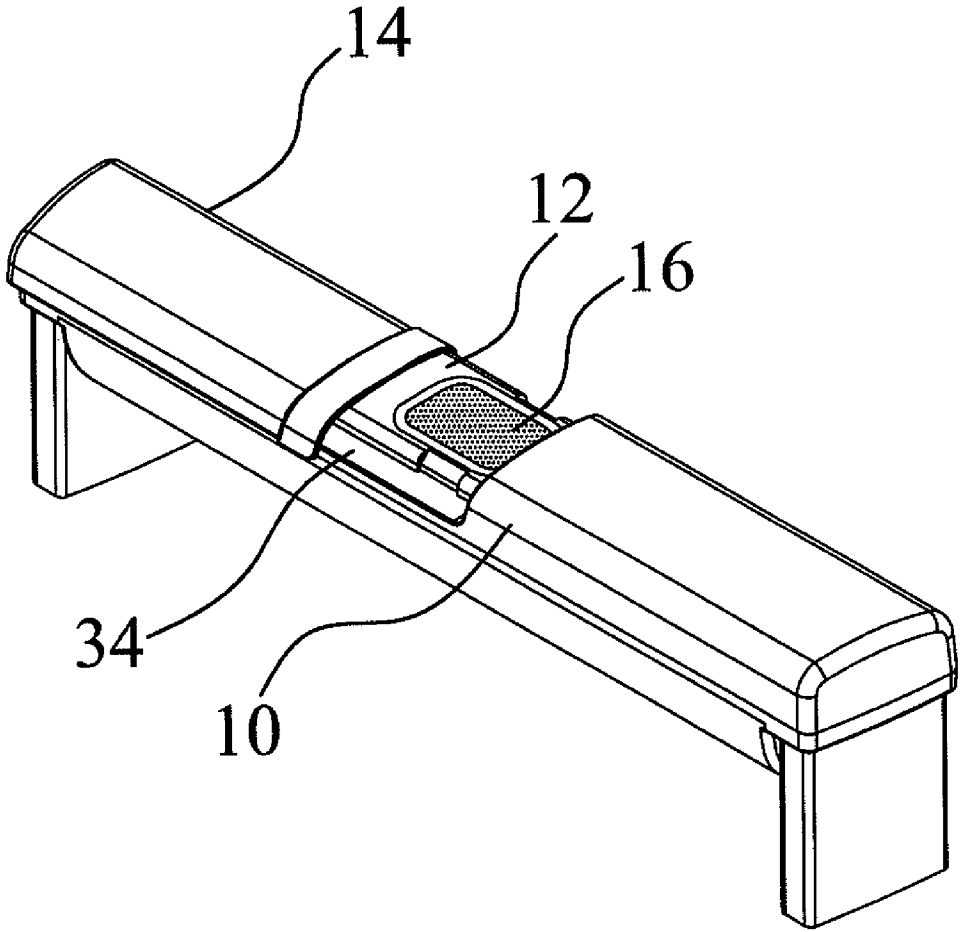
FIG. 1 is a perspective view schematically showing the structure of a slide-cover handlebar device according to one embodiment of the present invention.
Figure 2:
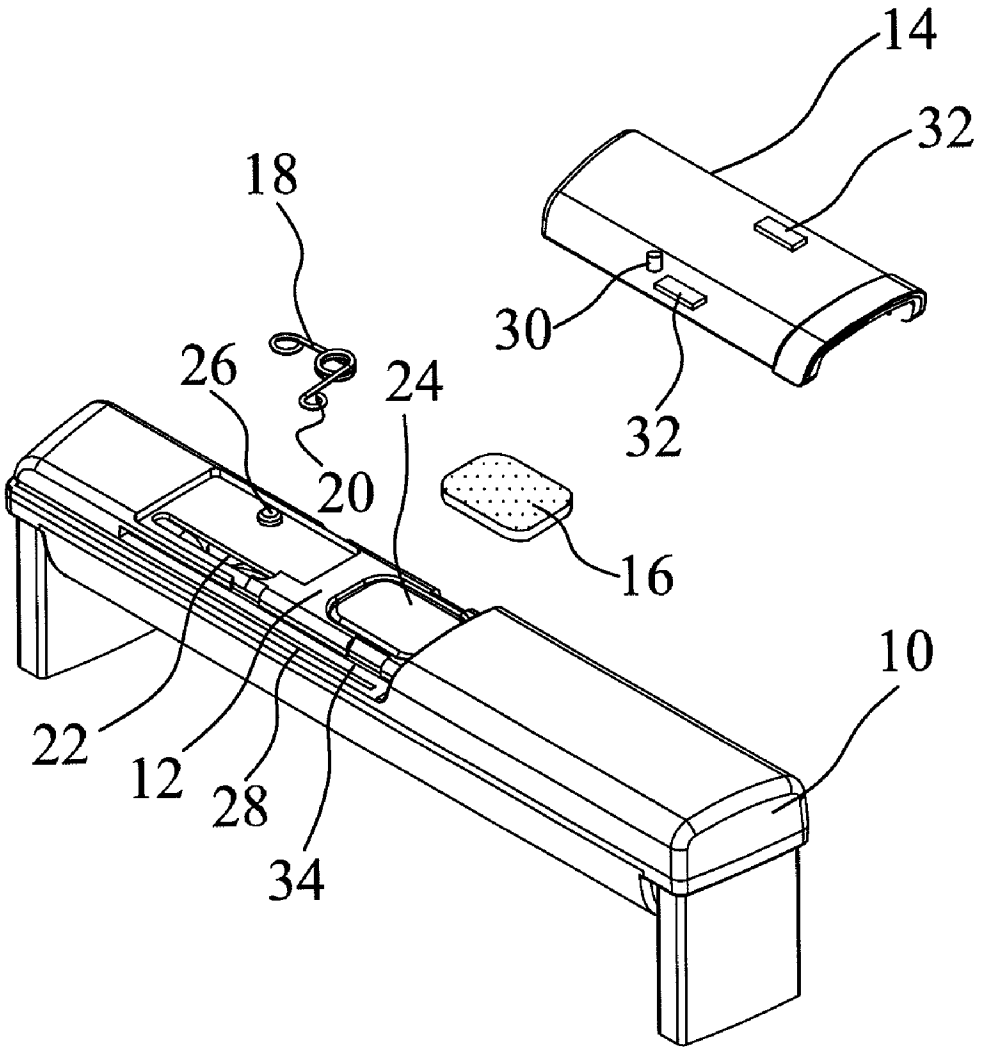
FIG. 2 is an exploded view schematically showing the structure of a slide-cover handlebar device according to one embodiment of the present invention.

Refer to FIG. 1 and FIG. 2 respectively a perspective view and an exploded view schematically showing the structure of a slide-cover handlebar device according to one embodiment of the present invention. The slide-cover handlebar device of the present invention comprises a handlebar body 10, a slide cover 14 and a torsion spring 18. The handlebar body 10 has a recession 12. Two slide grooves 34 are respectively formed on two sides of the recession 12. The recession 12 has a hole 24, and a button 16 is arranged inside the hole 24. The recession 12 also has an axial protrusion 26 and a slide track 22. The torsion spring 18 is securely installed in the recession 12 by the axial protrusion 26. The torsion spring 18 has a fixing ring 20 arranged corresponding to the slide track 22 of the recession 12. The slide cover 14 has a fixing protrusion 30 formed on the inner surface thereof. While the slide cover 14 covers the recession 12 of the handlebar body 10, the fixing protrusion 30 press-fits with the fixing ring 20 of the torsion spring 18. When the slide cover 14 is pulled to slide along the slide grooves 34, the fixing protrusion 30 pulls the torsion spring 18, whose fixing ring 20 is press-fitted with the fixing protrusion 30, to slide along the slide track 22. The torsion spring 18 will generate a rotation torsion force to pull the slide cover 14 to keep on sliding in the original pulling direction. The inner surface of the slide cover 14 has press-fit blocks 32. The slide track 22 has guide plates 28. When the slide cover 14 covers the recession 12, the press-fits blocks 32 and the guide plates 28 make the slide cover 14 firmly secured in the recession 12. The press-fits blocks 32 and the guide plates 28 also guide the slide cover 14 to smooth slide along the slide grooves 34.

Above has been described the structure of the present invention. Below will be described the operation of the torsion spring 18.

Figure 3:
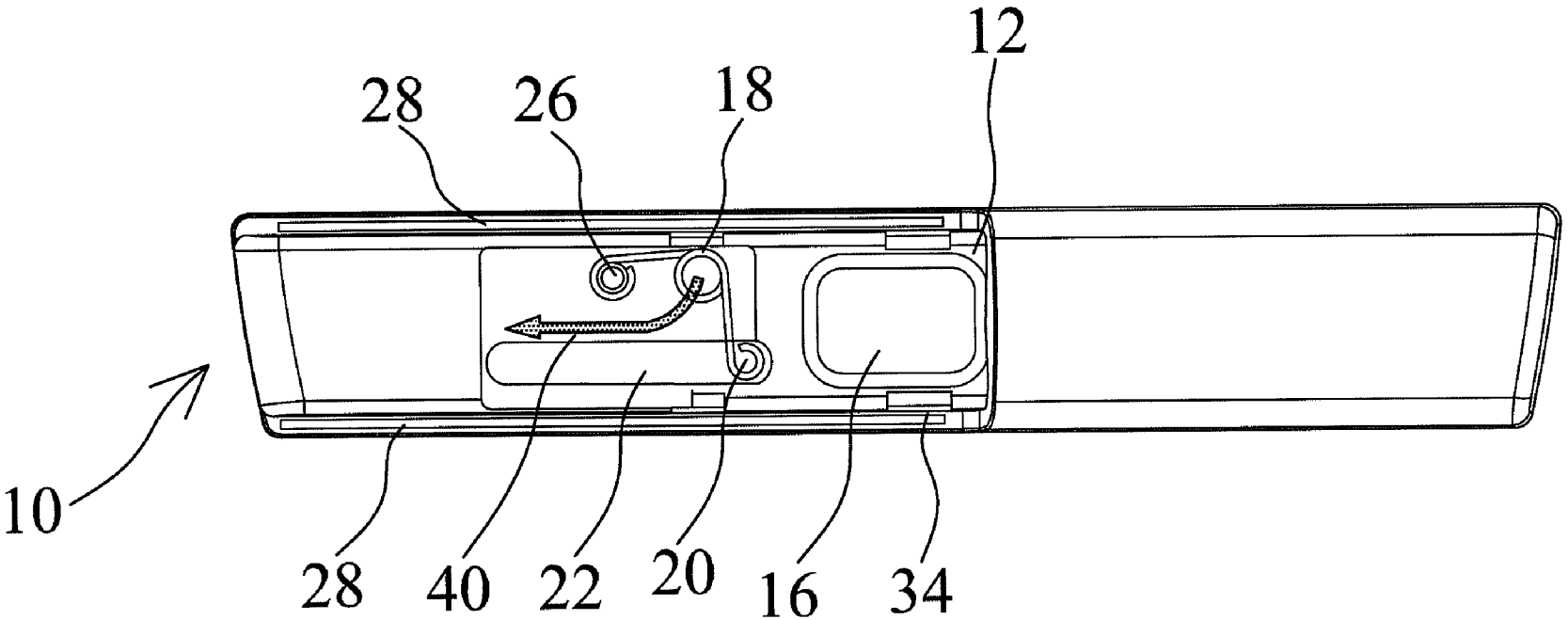
FIG. 3 is a top view schematically showing the structure of a slide-cover handlebar device according to one embodiment of the present invention.
Figure 4:
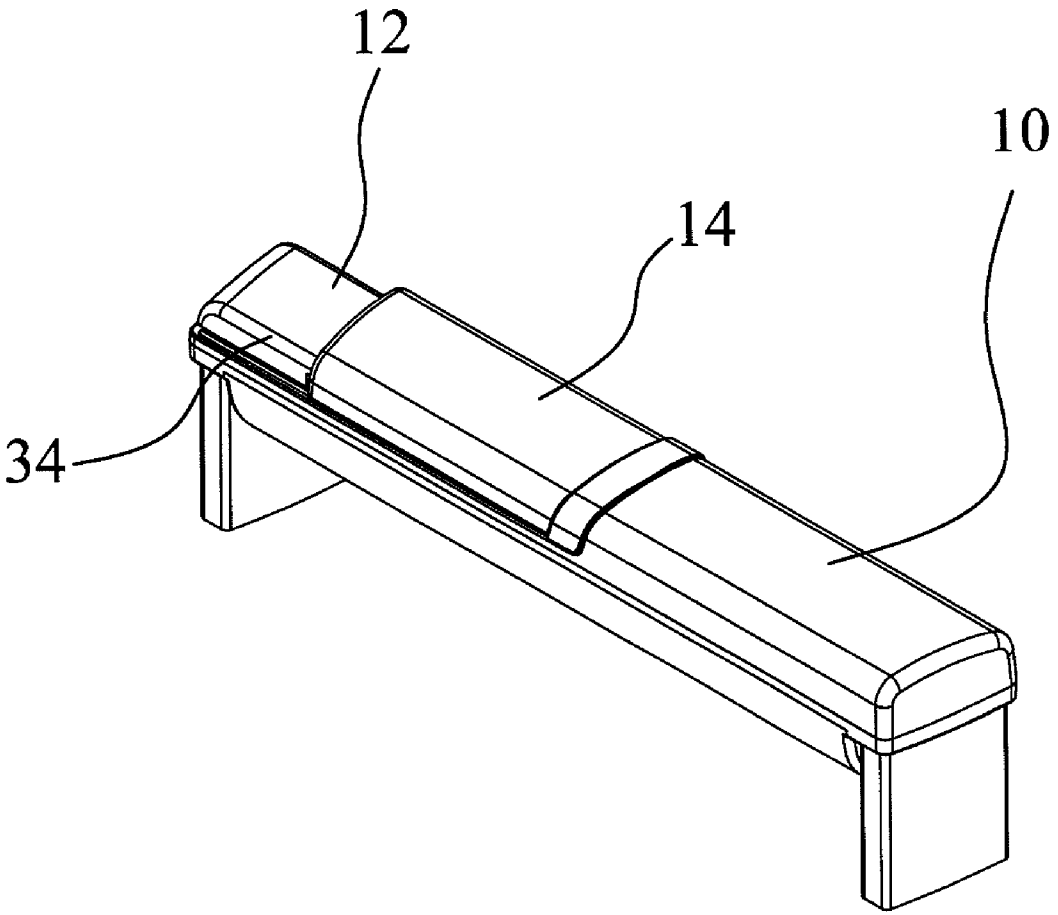
FIG. 4 is a diagram schematically showing that the slide cover of a slide-cover handlebar device is shut according to one embodiment of the present invention.

As shown in FIG. 3, when the slide cover 14 is pulled to open, the torsion spring 18, whose fixing ring 20 is press-fitted with the fixing protrusion 30, is also driven to move along the slide track 22 in the direction that the slide cover 14 is pulled with the axial protrusion 26 being the pivot, whereby the torsion spring 18 swings along a swing path 40. When the pulling force reaches a critical point, the torsion spring 18 generates a rotation torsion force to keep on pulling the slide cover 14 to slide in the original pulling direct until the slide cover 14 is completely opened. When the pulling force has reached the critical point, the user needn't keep on applying force to pull the slide cover 14, but the slide cover 14 still continues sliding. While the slide cover 14 is pushed to shut, the fixing protrusion 30 drives the torsion spring 18 to move along the slide track 22 in the direction that the slide cover 14 is pushed with the axial protrusion 26 being the pivot, whereby the torsion spring 18 swings along a swing path 40. When the pushing force has reached a critical point, the torsion spring 18 generates a rotation torsion force to keep on pushing the slide cover 14 until the slide cover 14 is completely shut.

When the user intends to reveal the button 16 from the handlebar body 10, the slide cover 14 is opened. When the user intends to conceal the button 16 inside the handlebar body 10, the slide cover 14 is shut. Refer to FIGS. 1-4. When pulling force is applied to the slide cover 14, the slide cover 14 slides along the slide grooves 34 until the button 16 is exposed to an extent that the user can easily press the button 16. When pushing force is applied to the slide cover 14, the slide cover 14 slides along the slide groove 34 until the slide cover 14 can protect the button 16 from being imprudently pressed.

Figure 5:
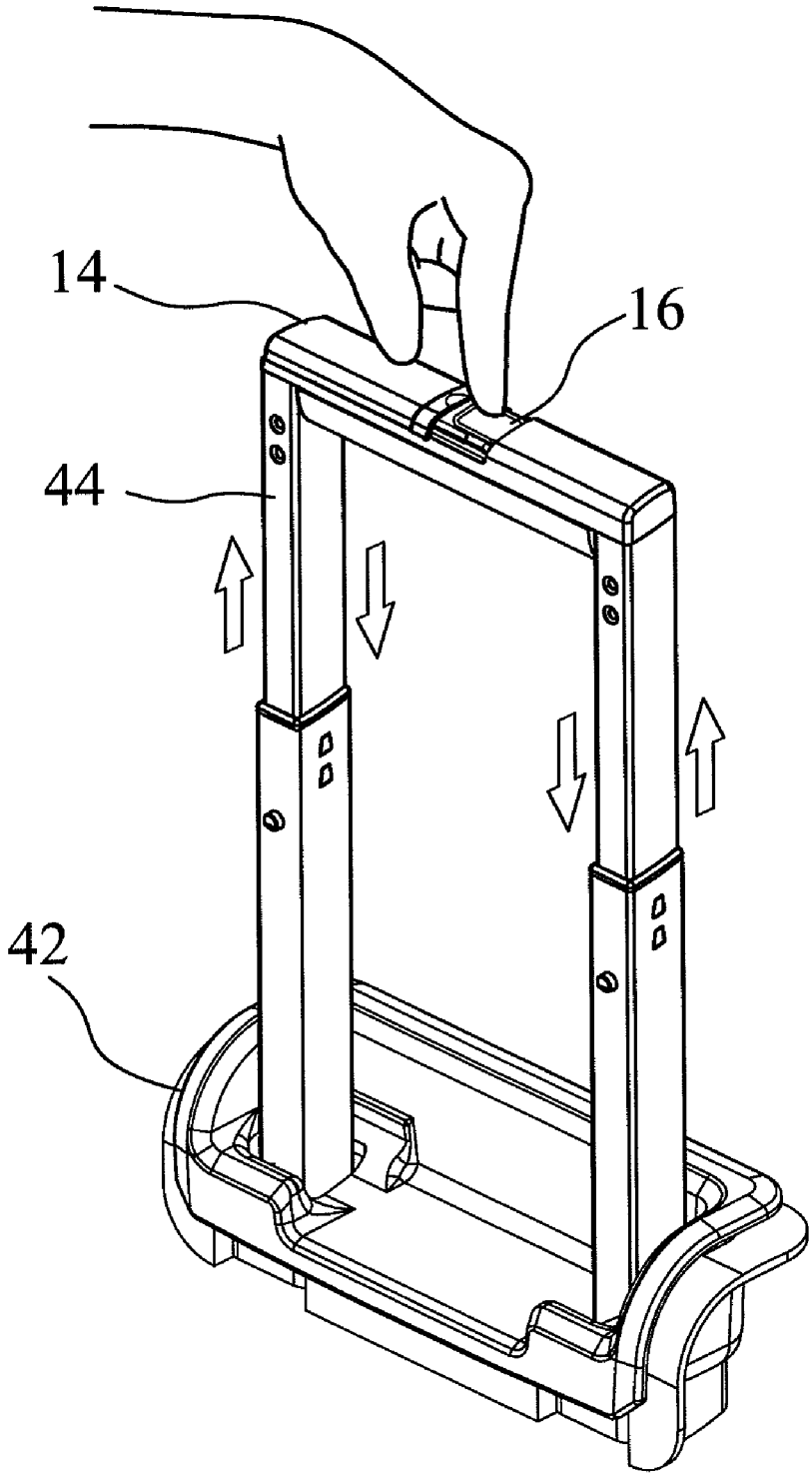
FIG. 5 is a diagram schematically showing that a slide-cover handlebar device is installed on a pull handle of a luggage trunk according to one embodiment of the present invention.
Figure 6:
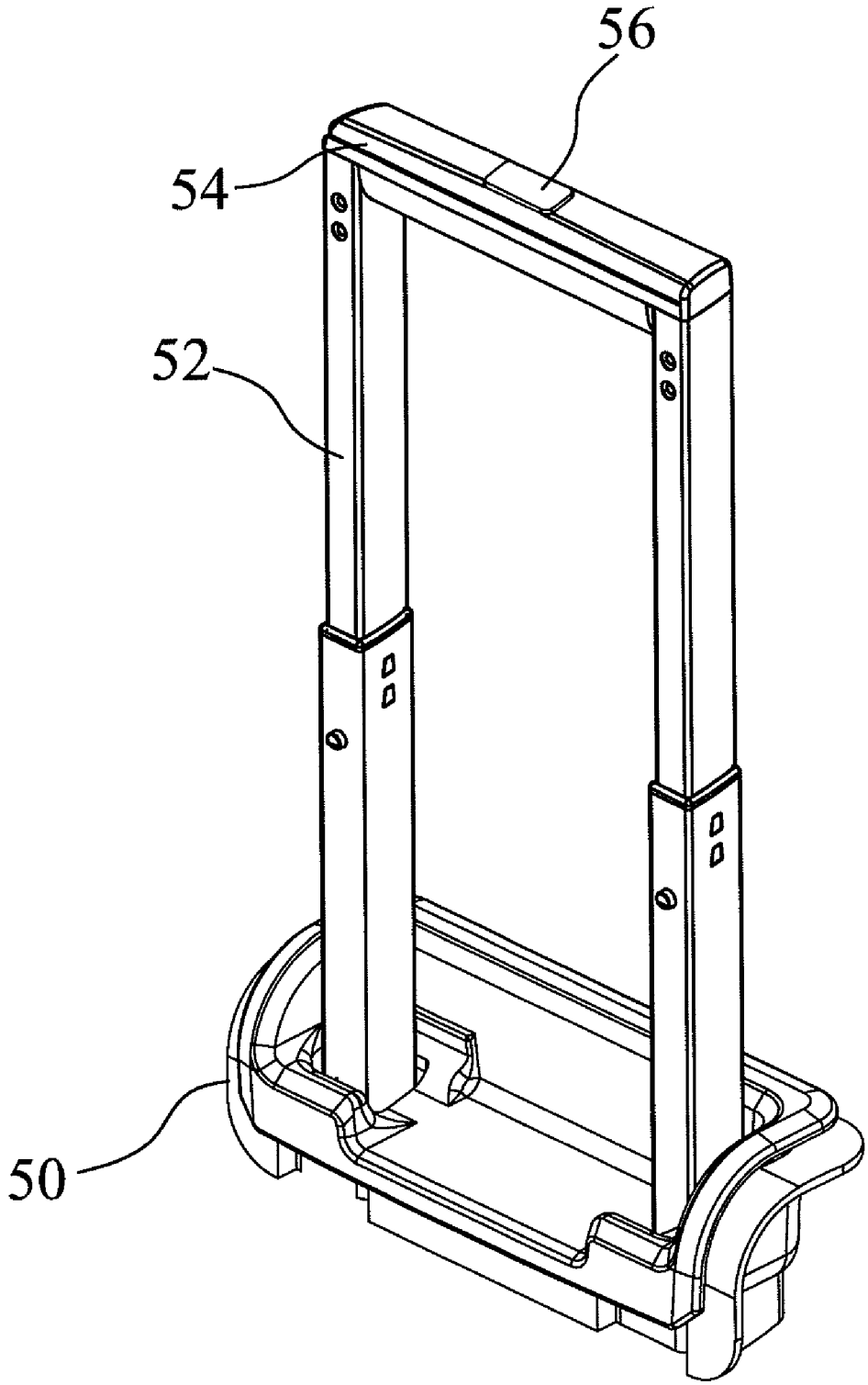
FIG. 6 is a diagram schematically showing a conventional pull handle of a luggage trunk.

Refer to FIG. 5 a diagram schematically showing that the slide-cover handlebar device of the present invention is installed on a pull handle of a luggage trunk. As shown in FIG. 5, the slide-cover handlebar device of the present invention is installed on a pull handle 44 of a luggage trunk 42. Two ends of the slide-cover handlebar device are fixed to the pull handle 44. When the slide cover 14 is opened and the button 16 is exposed, the user can press the button 16 to extend or retract the pull handle 44 of the luggage trunk 42. After the extended to retracted pull handle 44 has been fixed well, the slide cover 14 is pushed to cover the button 16 lest the button 16 be imprudently pressed.

The embodiments described above are to demonstrate the technical contents and characteristics of the present invention to enable the persons skilled in the art to understand, make, and use the present invention. However, the embodiments are not intended to limit the scope of the present invention. Any equivalent modification or variation according to the spirit of the present invention is to be also included within the scope of the present invention.

What is claimed is:

1. A slide-cover handlebar device, installed on a pull handle of a luggage trunk, comprising:

a handlebar body having a recession, wherein a button is installed inside said recession, and wherein said recession has a slide track and two slide grooves respectively on two sides thereof;

a torsion spring installed inside said recession and having a fixing ring arranged corresponding to said slide track; and a slide cover used to cover and open said recession of said handlebar body and having a fixing protrusion on an inner surface thereof, said fixing protrusion is press-fitted with said fixing ring and is slidable along said slide track, wherein when said slide cover is pulled or pushed along said slide grooves, said torsion spring is also driven by the fixing protrusion to rotate and thereby generate a rotation torsions force to pull or push said slide cove to keep on sliding in a pulled or pushed direction until the recession is completely opened or covered.

2. The slide-cover handlebar device according to claim 1 further comprising an axial protrusion, wherein said torsion spring is installed on said recession by said axial protrusion.

3. The slide-cover handlebar device according to claim 2, wherein said torsion spring swings along a swing path with said axial protrusion being a pivot, and wherein when pull force has reached a critical point, said torsion spring generates said rotation torsion force.

4. The slide-cover handlebar device according to claim 1 further comprising press-fit blocks formed on said inner surface of said slide cover and used to make said slide cover securely cover said recession.

5. The slide-cover handlebar device according to claim 4 further comprising guide plates arranged on said slide grooves and corresponding to said press-fit blocks, and used to guide said slide cover to smooth slide on said slide grooves.

6. The slide-cover handlebar device according to claim 1, wherein said button is revealed by pulling said slide cover along said slide grooves.

7. The slide-cover handlebar device according to claim 1, wherein said button is concealed by pushing said slide cover along said slide grooves.

8. The slide-cover handlebar device according to claim 1, wherein said recession has a hole for installing said button, and wherein said button controls extension and retraction of said pull handle.

* * * * *